United States Patent [19]

Mansfield

[11] Patent Number: 4,644,861

[45] Date of Patent: Feb. 24, 1987

[54] SYSTEM AND METHOD FOR INCREASED EFFICIENCY OF SCREW PRESSES

[76] Inventor: Peter W. Mansfield, 511 59th St., Holmes Beach, Fla. 33510

[21] Appl. No.: 814,485

[22] Filed: Dec. 30, 1985

[51] Int. Cl.[4] ..... B30B 9/14

[52] U.S. Cl. ..... 100/37; 100/117; 100/145

[58] Field of Search ..... 100/35, 37, 117, 145, 100/146, 147, 148, 149, 150

[56] References Cited

U.S. PATENT DOCUMENTS

| | | | |
|---|---|---|---|
| 635,868 | 10/1889 | Peck | 100/117 |
| 3,550,526 | 12/1970 | Hoover | 100/37 |
| 3,587,450 | 6/1971 | Smith | 100/117 |
| 3,980,013 | 9/1976 | Bredeson | 100/117 |
| 3,998,148 | 12/1976 | Mainka et al. | 100/117 |
| 4,024,168 | 5/1977 | Homann et al. | 100/37 |
| 4,256,033 | 3/1981 | Poznanovic | 100/117 |
| 4,304,054 | 12/1981 | Nauck | 100/117 |
| 4,440,076 | 4/1984 | Mansfield | 100/117 |
| 4,467,713 | 8/1984 | Knuth et al. | 100/37 |

*Primary Examiner*—Henry S. Jaudon
*Attorney, Agent, or Firm*—Charles J. Prescott

[57] ABSTRACT

An improved system and method for increasing the operational efficiency of screw-type presses which express or compress fluids from fibrous material. These improvements generally include improved means for compressing the fibrous material at its interface with both the hollow main shaft and the cylindrical outer housing of the press. Improved split worms having improved attaching means for each worm flight to the main shaft and collar therearound also contribute to improved efficiency. Further included is an improved means for draining the expressed fluids from the compression chamber radially inward into the hollow main shaft and radially outwardly through the outer housing wall of the compression chamber. In addition to improved radially outward drainage, improved wedge-shaped screen bars in the cylindrical outer housing walls eliminate the need for breaker bars which are otherwise necessary to reduce the spiraling effect of this fibrous material during compression. The improved method relates to intermittent compression relaxation of the fibrous material, followed by aeration of the compression chamber and fibrous material with a compressed gas.

24 Claims, 16 Drawing Figures

SYSTEM AND METHOD FOR INCREASED EFFICIENCY OF SCREW PRESSES

BACKGROUND OF THE INVENTION

This invention relates generally to screw presses for expressing liquids from fibrous materials, and more particularly, to high pressure expressing presses capable of continuous operation, and to improved operating efficiency thereof.

Dewatering expressing presses are used on a variety of organic products to expel liquids from the fibrous solid material. In most cases, any remaining liquid must be removed through an evaporative drying process and the expenditure of considerable amounts of heat energy thereby. Examples requiring a secondary drying process are found in drying brewery spent grain, bagasse drying, waste solid concentration, and various vegatable oil extractions.

Screw presses used to express liquids from fibrous materials are well known in the industry. As prior art, applicant cites his earlier U.S. Pat. No. 4,440,076, and further prior art cited therein. Applicant's said prior patent was directed to improvements in efficiency derived from improved center drainage chamber design and screen bar placement. Other prior art known to applicant related to matters of efficiency in these screw presses are disclosed in U.S. Pat. No. 3,998,148 to Mainka, et al, and a U.S.S.R. Pat. No. 737,446.

One aspect of applicant's improvements in efficiency is derived from the particular construction of split-type worms and worm flights. In this regard, applicant further cites prior art in U.S. Pat. No. 3,980,013 to Bredeson which relates only generally to split, collared worm flights, and to similarly directed prior U.S. Pat. No. 635,868 to Peck.

The present invention discloses improved structure in the size and shape of screen bars in the collar surrounding the hollow main shaft, as well as those in the walls of the cylindrical main housing for improved liquid discharge from the compression chamber, as well as increased screen bar area available in the collar derived from improved split worm flight design. An improved method of operation relates to the intermittent introduction of compressed gas into the compression chamber during intermittent periods of compression relaxation. Further benefits derived from the improved screen bar design in the cylindrical outer walls relate to the elimination of otherwise necessary breaker bars, consequently reducing energy consumption. These improved screen bars are longitudinally and radially inwardly disposed from the main housing for eliminating spiraling of the fibrous material and for improved efficiency.

BRIEF DESCRIPTION OF THE INVENTION

The present invention is directed to an improved system and method for increasing the operational efficiency of screw-type presses which express or compress fluids from fibrous material. These improvements generally include improved means for compressing the fibrous material at its interface with both the collar surrounding the hollow main shaft and the cylindrical outer housing of the press. Split worm flights having improved attaching means for each worm flight and collar therearound to the main shaft also contribute to improved efficiency and maintainability. Further improvements also include improved means for draining the expressed liquids from the compression chamber radially inward into the hollow main shaft and radially outwardly through the outer housing wall of the compression chamber. In addition to improved radially outward drainage, improved wedge-shaped screen bars in the cylindrical outer housing walls eliminate the need for breaker bars which are otherwise necessary to reduce the spiraling effect of this fibrous material during compression. The improved method relates to intermittent compression relaxation of the fibrous material, followed by aeration of the compression chamber and fibrous material with a compressed gas.

It is therefore an object of this invention to provide increased efficiency in the operation of dewatering mechanical screw presses by the improvement in structure of screen bars positioned both in the hollow main shaft and in the cylindrical outer housing wall.

It is another object of this invention to provide improved split worms which increase available area on the surface of the main hollow shaft and surrounding collar for screen bars and also may provide variable degrees of compression during each revolution.

It is yet another object of this invention to eliminate breaker bars from the inner surface of the cylindrical outer housing of the compression chamber by the improved tapered design of the screen bars in this area.

It is yet another object of this invention to provide an improved method of operating mechanical screw presses.

And still another object of this invention is to reduce labor maintenance costs and increase the operating life of dewatering mechanical screw presses.

In accordance with these and other objects which will be apparent hereafter, the instant invention will now be described with particular reference to the accompanying drawings.

DETAILED DESCRIPTION OF THE INVENTION

Figure 1:
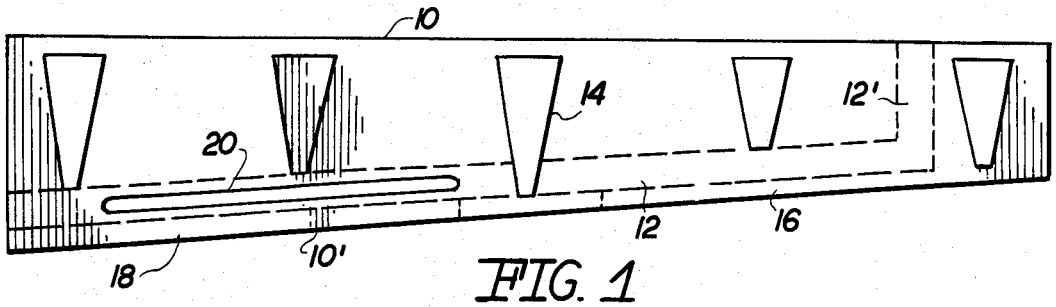
FIG. 1 is a side elevation view of the improved screen bar to be fitted into the inner surface of the cylindrical outer housing of the compression chamber.
Figure 2:
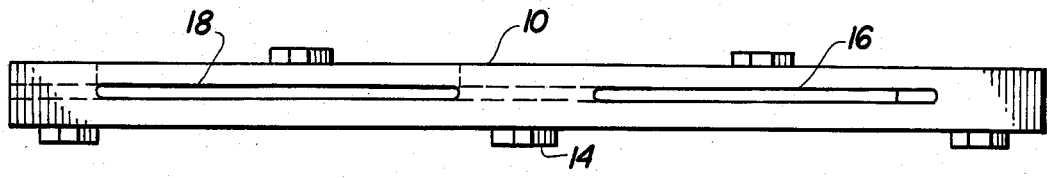
FIG. 2 is a bottom view of the screen bar shown in Figure 1.
Figure 3:
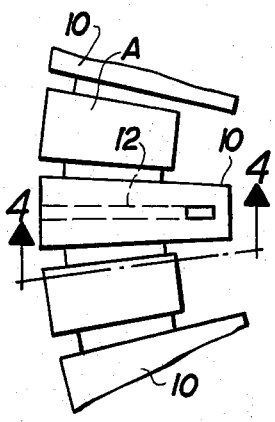
FIG. 3 is an end view of a portion of the cylindrical housing, having the screen bar as shown in FIGS. 1 and 2 therethrough positioned between standard or conventional screen bars.
Figure 4:
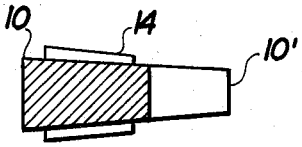
FIG. 4 is a section view in the direction of arrows 4—4 in FIG. 3.

Referring now to the drawings, and particularly to FIGS. 1–4, improved outer cylindrical housing wedge-shaped screen bars are shown generally at 10. These outer housing screen bars 10 are held radially disposed adjacent to conventional screen bars A as shown in FIG. 3 and radially disposed around the peripheral tip of the worm flights. Within the screen bars 10 are provided cavities 12 having openings 16, 18 and 20 which are disposed to receive expressed fluids. These fluids are expressed outwardly out of the compression chamber through, in addition to the slits formed between each screen bar A and 10 by spacer portions 14, also through and out discharge portion 12′ of cavity 12.

An important benefit of the wedge shaped screen bar 10 is the tapered lower surface 10′ which gradually extends radially inward into the compression chamber moving in the direction of the expressed fibrous material. In conventional screw presses, large breaker bars are placed longitudinally on the inside of the compression chamber to prevent or reduce spiraling of the fibrous material. This restriction improves the screw press efficiency by restricting spiraling of the fibrous material during compression. However, these breaker bars include blunt leading ends and extend sufficiently into the path of the moving fibrous material which includes foreign material therein, such as rocks and stones, that frequent damage will occur to the breaker bars, resulting in equipment down time. Further, a significant loss of energy occurs in driving the fibrous material against the blunt ends of the breaker bars. These improved wedge-shaped screen bars 10 eliminate the blunt leading end, and damage thereto, while still retaining the anti-spiraling features of conventional breaker bars. The tapered lower surface 10′ provides gradual increased compression, spiraling restriction, and also providing additional fluid exit means through openings 16, 18 and 20 at and along an area where the fibrous material is more highly compressed.

Figure 5:
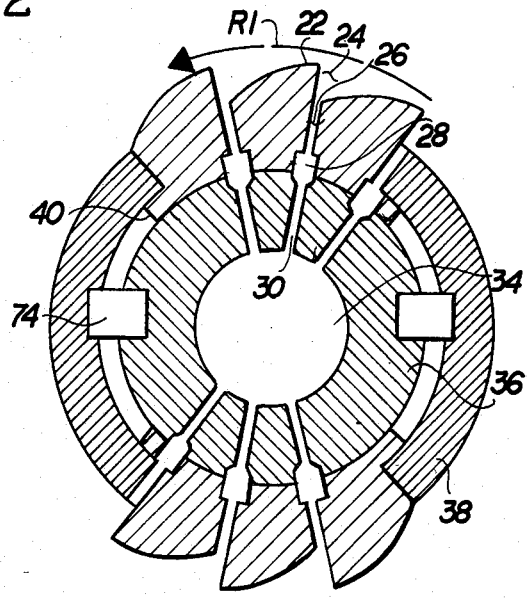
FIG. 5 is a sectional view of the main hollow drive shaft and surrounding collar and one embodiment of the improved center drainage screen bars in the direction of arrows 5—5 in FIG. 10.
Figure 10:
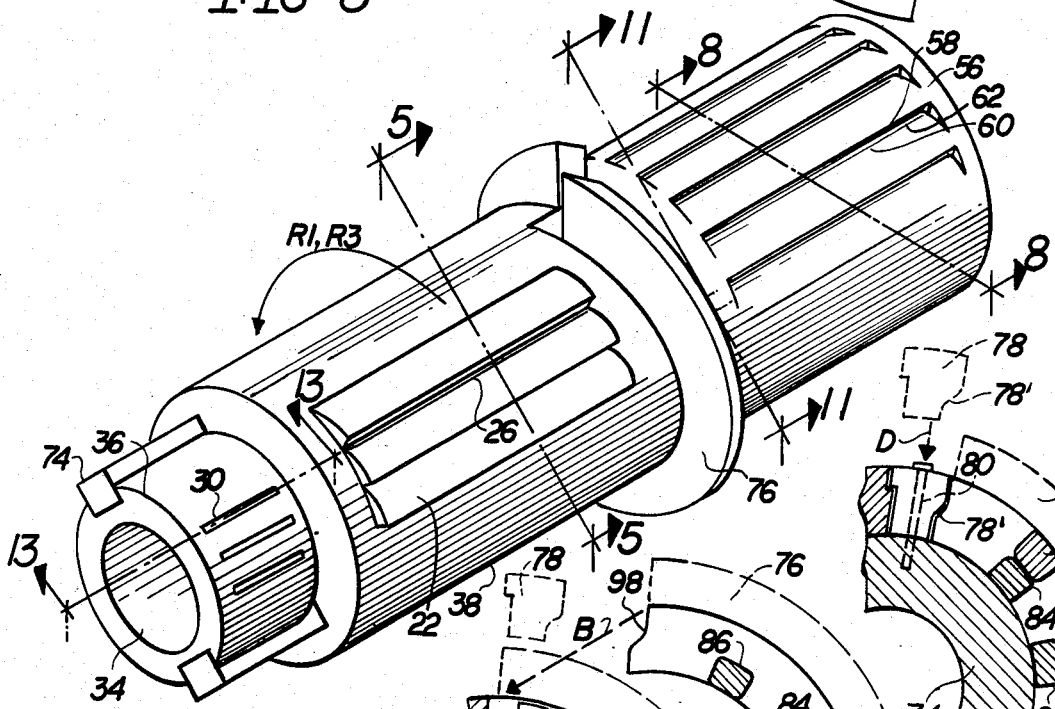
FIG. 10 is a perspective view of the main shaft, collars and worm flights showing alternate embodiments of the improved center drainage screen bar structure therein.
Figure 13:
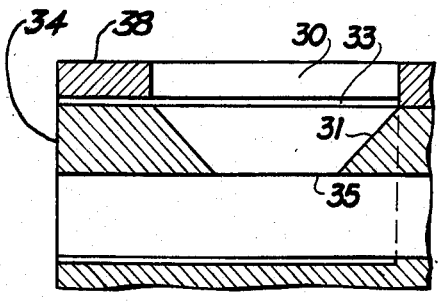
FIG. 13 is a partial section view in the direction of arrows 13—13 in FIG. 10.

Referring now to FIGS. 5, 10 and 13, an improved structure is shown which provides both improved fluid extraction from the fibrous material and improved exit means for those expressed fluids into the hollow main shaft 34 of the screw press. The main shaft 34 includes at least one drive key 74 which interengage to drive collar 38. The main shaft is hollow as shown and includes a plurality of apertures 30 through its entire wall thickness. The collar 38 includes center drainage screen bars 22 which are suitably retained within the collar 38 by tang 40 and other convenient means so as to form slots 26. The trailing edges of these screen bars are radially extended as compared to the leading edges such that a void is created in the area of numeral 24 outwardly adjacent to the inlets for slot 26. By this means, as the collar 38 is rotated in the direction of R1 and against the fibrous material within the screw press chamber, the fibrous material is repeatedly compressed slightly or "patted" to extract additional fluids, which are then allowed to more easily pass into slits 26 due to the reduced pressure necessarily created by the void at area 24. This novel center drainage screen bar structure also prevents or reduces clogging of slots 26. The expressed fluids are then conveyed into the main hollow drive shaft 34 through apertures 30, which are in allignment, and in fluid communication, with slits 26. An enlarged portion 28 is also provided at the interface between apertures 30 and slots 26 to reduce the effect of rotational misalignment and enhance fluid flow into the main shaft 34 for disposal.

Figure 6:
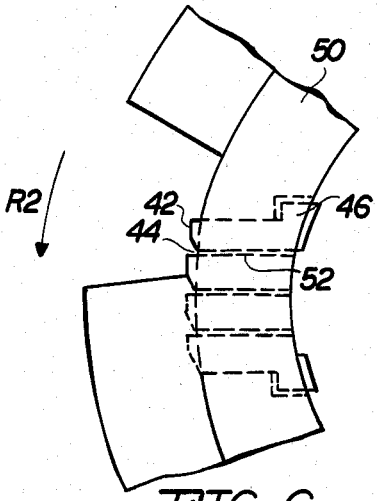
FIG. 6 is a broken view of a portion of the collar and worm flights showing an alternate embodiment for the improved center drainage screen bars.
Figure 7:
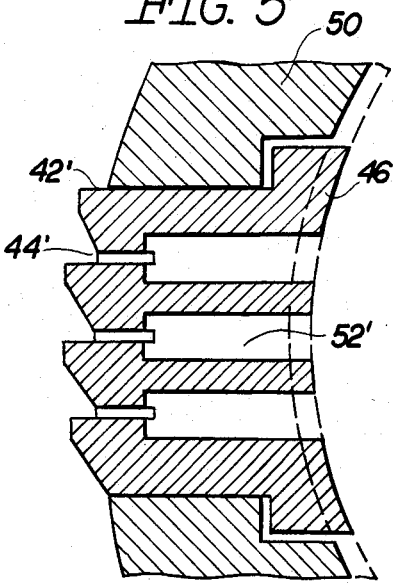
FIG. 7 is a partial section view of the collar showing an alternate embodiment for the improved center drainage screen bars.

Referring now to FIGS. 6 and 7, two alternate embodiments of the center drainage screen bars are shown generally at 42 and 42′ in the form of a unitized insert including a plurality of individual screen bars formed into a single unit 42 and 42′ for easy insertion into the collar 50. These screen bar inserts 42 and 42′, also having radially extended trailing edges in a slightly different end contour, also form slits 44 and 44′ therebetween which are in fluid communication with passages 52 and 52′ for delivery of the expressed fluids into passages in the hollow main shaft (not shown). Flanges 46 serve to securely retain these screen bar inserts 42 and 42′ within a mating cavity in collar 50. Note that, similar to the embodiment shown in FIG. 5, rotation of the collar 50 and screen bar insert 42 in the direction of arrow R2 has the same beneficial fluid extraction effect produced by the end contour of each individual screen bar.

Figure 8:
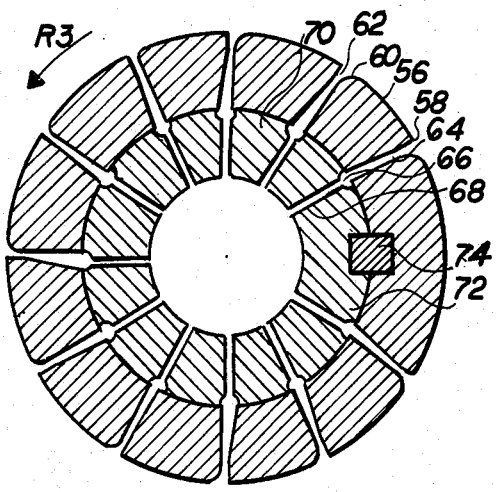
FIG. 8 is a section view of the main shaft in the direction of arrows 8—8 in FIG. 10.
Figure 9:
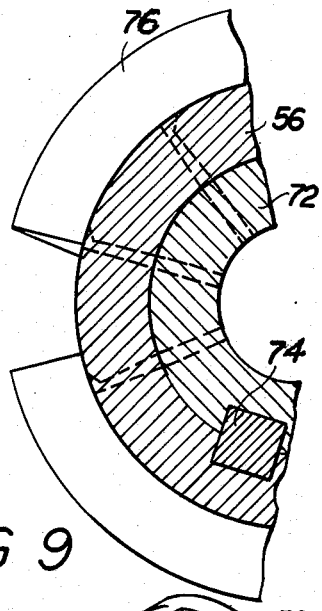
FIG. 9 is a broken right end elevation view of the main shaft shown in FIG. 10.

Another embodiment of the improved center draining screen bars is shown generally in FIGS. 8, 9 and 10. In this embodiment, the center drainage slots 64 are formed into the collar 56, resulting in a generally circumferential outer contour. However, the rearward edge 60 of each center drainage slot 64 at 60 is rounded to produce the same negative pressure type cavity at 62 which results by rotating the drive shaft 72 and collar 56 in the direction of arrow R3. The expressed fluids extracted from the fibrous material by worm flights 76 more easily enter into the main hollow shaft 72 because of the negative pressure created at area 62. Center drainage slots 64 and mating apertures 68 in the main drive shaft 72 are enlarged at their interface to reduce or eliminate the detrimental effect of rotational misalignment.

Figure 12:
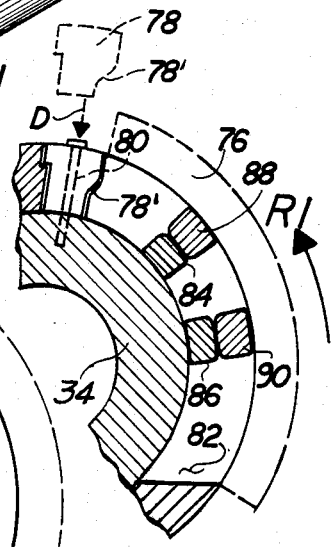
FIG. 12 is a view similar to that in FIG. 11 depicting one means for locking and securing the worm flight in place in relation to the main shaft and collar.
Figure 11:
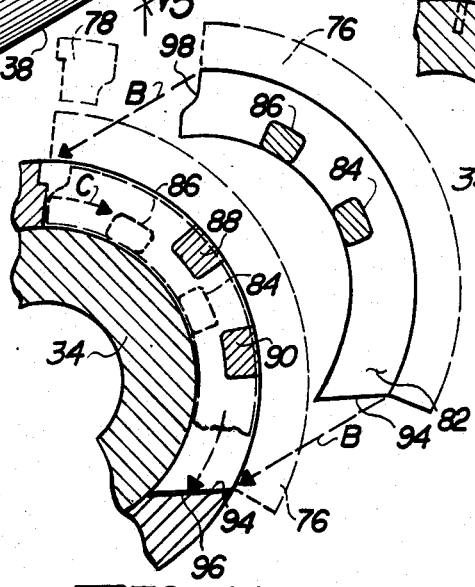
FIG. 11 is an exploded section view in the direction of arrows 11—11 in FIG. 10 depicting installation of one improved worm flight.

Referring now to FIGS. 10, 11 and 12, the improved worm includes two mating worm flights 76 which are adapted and structured to reduce the amount of surface area in the collar in order to maximize the surface area available for the improved center drainage screen bars and/or center drainage slots previously discussed. As is well known, the worm flight 76, having a spiral-type section, serves to compress the fibrous material in screw-type fashion as the main shaft 34 is rotated. Traditionally the worm and attached or integral worm flights were slid onto and off of the main shaft in similar fashion to that of the collar. However, in my previously referenced patent, the worm flights were improved in structure and function by splitting the worm in half and allowing installation thereof without disassembly of the other components on the main shaft. The present improvement carries the serviceability one step further, while also enhancing the operating efficiency of screw presses. As can be seen, the only collar surface area dedicated to each worm flight is substantially that necessary for the worm flight 76 itself. As best seen in FIG. 11, the worm flight 76 is moved into the collar cavity in the direction of arrows B and, thereafter, is rotated in the direction of arrow C such that dogs 84 and 86 included on worm flight portion 82 interengage and mate with dogs 88 and 90 included on the mating wall surface of the collar 38. This mating interengagement of dogs 84, 86, 88 and 90 serves, as best shown in FIG. 12, to securely lock the worm flight 76 in place during operation. One end 82 of the worm flight 76 is tapered as shown so as to slide somewhat underneath a mating section of the collar 38 at 96 to abut at 94 and to further enhance the locking characteristics of this improved worm flight 76. A keystone 78 is then bolted into place as shown in FIG. 12. By first moving the keystone 78 in the direction of arrow D, contoured surface 78' lockingly interengages against the mating surface of the other end of the worm flight 76 at 98. Bolt 80 then secures the keystone 78 in place during service.

Figure 14:
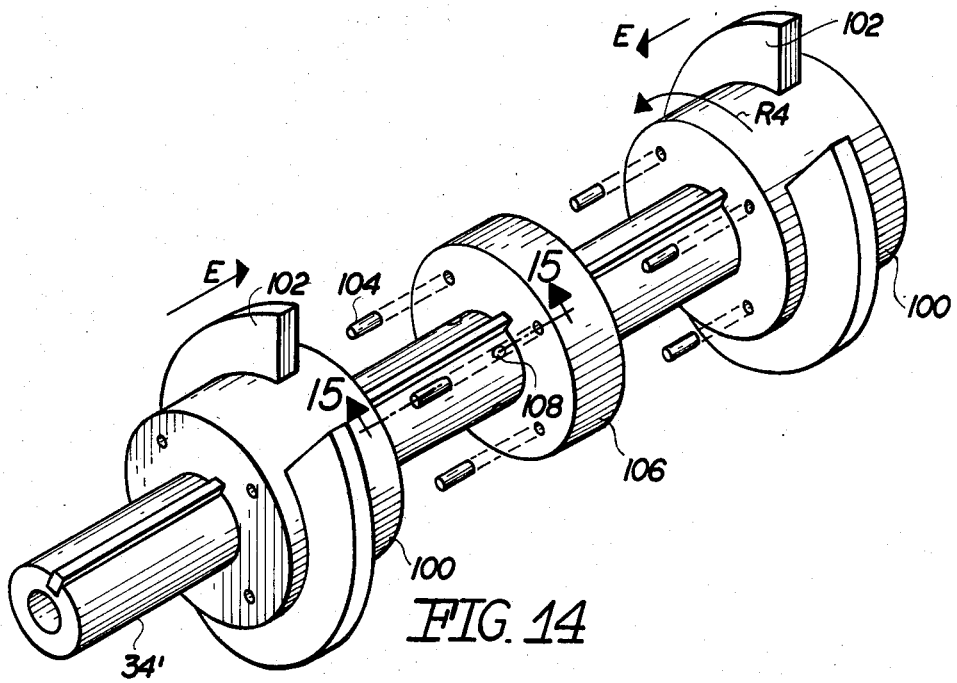
FIG. 14 is an exploded perspective view of the main shaft, collar and worms showing an alternate embodiment of the improved center drainage aperatures disposed in the main shaft and means for producing radially and perpendicularly disposed center drainage slots between the collar and the worms.
Figure 15:
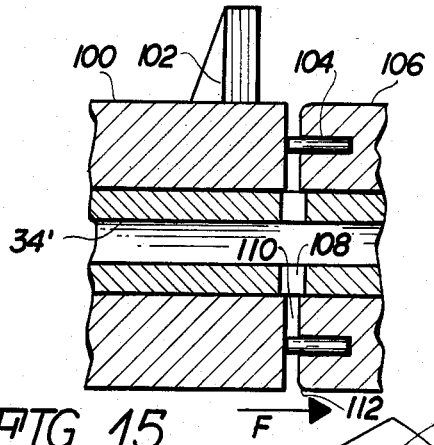
FIG. 15 is a section view in the direction of arrows 15—15 in FIG. 14.

Referring now to FIGS. 14 and 15, an alternate embodiment of the improved center drainage is shown. Worms 100 having worm flights 102 thereon are slideably positionable along the hollow main shaft 34' and are shown positioned on either side of collar 106, also slideably positionable on hollow main shaft 34'. Pins 104 are insertable into mating apertures in collar 106 and are sized to protrude slightly from the side surface of the collar such that when worms 100 are slid against collar 106 in the direction of arrows E, radial and perpendicular slit 110 is created therebetween. Slit 110 is in alignment and fluid communication with apertures 108 in the hollow main shaft 34'. These apertures 108 are slightly enlarged to enhance expressed fluid flow into the main hollow shaft, particularly where the fluid is carrying fibrous material in suspension.

As the worms 110 rotate in the direction of R4, the expressed fibrous material moves in the direction of arrow F in FIG. 15. To enhance the fluid entrance into slit 110 by reducing the fibrous material build-up there, the trailing outer edge 112 formed by the collar 106 is rounded to produce a low pressure area at the entrance of the slit as previously described.

An alternate embodiment of this form of the improved center drainage is formed by slicing collar 106 into a plurality of disc-shaped segments each being spaced apart by pins 104 seeded in mating pockets in each disc segment. By this means, a plurality of radial and perpendicularly disposed center drainage slits are produced.

Figure 16:
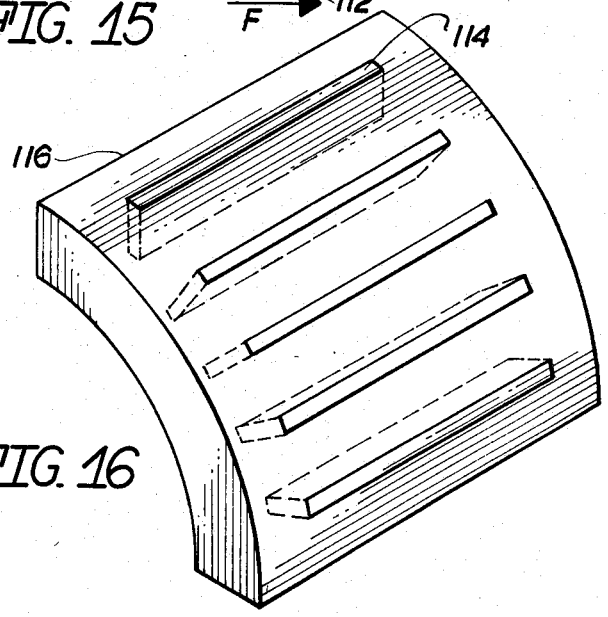
FIG. 16 is a perspective view of the replaceable housing screen bar insert.

Referring to FIG. 16, the outer housing screen bar insert is shown at 116 having a plurality of elongated longitudinally disposed housing drainage slots 114 therethrough. Having a plurality of these housing screen bar inserts 116 positioned in the outer housing wall in an end-to-end fashion circumferentially provides the necessary housing drainage slots 114 in a form which is easily serviceable and replaceable.

Improved Method of Operation

During the normal operation of a screw press, the compression is continuous by the continuous rotation of the main shaft. The fibrous material is loaded intermittently or continuously during this compression process and discharges at the opposite end of the press, having been dewatered during this process. However, it is well known that substantial amounts of fluid remain in the fully compressed discharging fibrous material. In some cases, where anhydrous fibrous material is required, further drying by heating or other conventional methods is required. However, all of the above improvements are intended to provide improved structure and function which enhance the dewatering capabilities and efficiency of these conventional screw presses.

The improved method includes the intermittent introduction of a gas under pressure into the compression chamber during each scheduled compression relaxation cycle. This compression relaxation may be effected by a variable pitch in the worm flights or by a variation in chamber size or the like. The pressurized gas, preferrably compressed air, may be introduced into the compression chamber through the main hollow shaft and center drainage slots, through the outer screen bar slots, or through either end of the compression chamber. The compressed gas is intended to redistribute the fibrous materials so as to provide new surface contact within the fibrous material. Thereafter, recompression within the chamber will extract greater amounts of fluids due to the relaxation and then rearrangement by compressed gas.

While the instant invention has been shown and described herein and was conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. In a high pressure mechanical screw press system for removal of fluids from organic materials such as sugar cane, meal, nuts, bagasse and other fibrous materials including a hollow main shaft, at least one pressure chamber having an outer cylindrical housing, at least one feed worm, and collars arranged on said hollow main shaft, securing means for securing said worms and collars on said hollow main shaft, said worms rotationally driven by said hollow main shaft to express fluids from the fibrous material within said at least one pressure chamber, wherein the improvement comprises:

a plurality of center drainage slots disposed in said collar;

a plurality of center drainge apertures disposed in said main shaft in fluid communication with said drainage slots;

the outer surface between each said center drainage slot adapted to create a pocket adjacent each said drainage slot for enhancing fluid flow into said center drainage slots and for reducing build up of fibrous material at said pockets.

2. An improved high pressure mechanical screw press system as set forth in claim 1, wherein:

said center drainage slots and apertures are generally elongated and longitudinally disposed.

3. An improved high pressure mechanical screw press system as set forth in claim 2, further comprising:

a plurality of generally longitudinally disposed elongated center drainage screen bars in at least one said collar;

each said center drainage screen bar having a leading and a trailing edge;

each pair of adjacent said center drainage screen bars forming said center drainage slots therebetween;

the outer surface of each said center drainage screen bar adapted to create said longitudinal pocket adjacent the outer end of each said center drainage slot.

4. An improved high pressure mechanical screw press system as set forth in claim 3, wherein;

each said outer surface of each said center drainage screen bar is contoured such that each said leading edge is generally on the outer surface of said collar and each said trailing edge is radially extended outward from said outer surface of said collar.

5. An improved high pressure mechanical screw press system as set forth in claim 4, wherein:

said plurality of center drainage screen bars are unitized to form an insert which is releaseably lockable into a mating aperture in said collar.

6. An improved high pressure mechanical screw press system as set forth in claim 3, wherein:

each said outer surface of each said center drainage screen bar is generally continuous with the outer surface of said collar;

7. An improved high pressure mechanical screw press system as set forth in claim 3, wherein:

said drainage apertures in said main shaft have an entrance and an exit;

each said entrance is larger than each said exit;

the end interior surface forming each said drainage aperture in said main shaft is tapered between each said entrance and exit.

8. An improved high pressure mechanical screw press system as set forth in claim 1, wherein:

said center drainage slots and apertures are generally radial and perpendicularly disposed.

9. An improved high pressure mechanical screw press system as set forth in claim 8, wherein:

said drainage slots are formed by spacing means for separating said worm and said collar.

10. An improved high pressure mechanical screw press system as set forth in claim 9, wherein:

said collar is radially segmented into a plurality of discs having said spacing means between each disc for creating an additional drainage slot between each pair of adjacent said discs.

11. An improved high pressure mechanical screw press system as set forth in claim 1, further comprising:

means for producing a variable rate of compression of the fibrous material during each revolution of said main hollow shaft;

aeration means for introducing a quantity of compressed gas into the fibrous material in said compression chamber during periods of lower rates of compression as produced by said shaped means.

12. An improved high pressure mechanical screw press as set forth in claim 11, wherein:

said aeration means introduces said compressed gas through said main hollow shaft.

13. In a high pressure mechanical screw press system for removal of fluids from organic materials such as sugar cane, meal, nuts, bagasse and other fibrous materials including a hollow main shaft, at least one pressure chamber having an outer cylindrical housing, at least one feed worm, and collars arranged on said hollow main shaft, securing means for securing said worms and collars on said hollow main shaft, said worms rotationally driven by said hollow main shaft to express fluids from the fibrous material within said at least one pressure chamber, wherein the improvement comprises:

a plurality of tapered elongated housing screen bars disposed in the wall of said housing and forming housing drainage slots between each said tapered housing screen bar and a conventional housing screen bar;

each said tapered housing screen bar having an interior surface which tapers radially inward into said compression chamber in the direction of the moving fibrous material.

14. An improved high pressure mechanical screw press system as set forth in claim 13, wherein:

each said tapered housing screen bar includes a drainage cavity therein having an inlet in said interior surface and an outlet exiting from said compression chamber;

said drainage cavity for increasing the outward flow of expressed fluids from said compression chamber.

15. An improved high pressure mechanical screw press system as set forth in claim 13, wherein:

each said tapered housing screen bar and each said conventional housing screen bar are longitudinally aligned with the axis of said main shaft.

16. An improved high pressure mechanical screw press system as set forth in claim 13, wherein:

each said tapered housing screen bar and each said conventional housing screen bar are nonaligned with the axis of said main shaft and slanting counter to rotation of said main shaft.

17. In a high pressure mechanical screw press system for removal of fluids from organic materials such as sugar cane, meal, nuts, bagasse and other fibrous materials including a hollow main shaft, at least one pressure chamber having an outer cylindrical housing, at least one feed worm, and collars arranged on said hollow main shaft, securing means for securing said worms and collars on said hollow main shaft, said worms rotationally driven by the hollow main shaft to express fluids from the fibrous material within at least one pressure chamber, wherein the improvement comprising:

segmented worms having a plurality of worm flights;

each said worm flight including means for releaseable retention into a mating worm flight cavity in said collar;

said worm flight retention means including interengaging structure at one end of each said worm flight and one end of each said worm flight cavity in said collar such that, when each said worm flight is positioned in one said worm flight cavity for use, said worm flight cavity end overlaps and secures said one end of said worm flight;

said worm flight retention means also including a keystone releaseably securable in said worm flight cavity adjacent the other end of said worm flight such that said keystone overlaps and secures the other end of said worm flight.

18. An improved high pressure mechanical screw press system as set forth in claim 17, wherein said worm flight retention means also includes:

at least one pair of interengaging locking dogs, the first said locking dog connected to a wall of each said worm flight cavity, the second said locking dog connected to a side of each said worm flight;

said first and second locking dogs moving into rotational alignment as each said worm flight is positioned in said worm flight cavity for use, said first locking dog then radially outward from, and against, said second locking dog.

19. An improved high pressure mechanical screw press system for removal of fluids from organic materials such as sugar cane, meal, nuts, bagasse, and other fibrous materials comprising:

a hollow main shaft held for driven rotation within at least one pressure chamber;

said pressure chamber having an outer cylindrical housing;

at least one feed worm having a worm flight thereon;

at least one collar;

said worm and collar arranged on and driven by said hollow main shaft;

said worm flight for expressing the fluids from the fibrous material;

a plurality of center drainage slots disposed in said collar;

a plurality of center drainage apertures disposed in said main shaft in fluid communication with said drainage slots;

the outer surface between each said center drainage slot adapted to create a pocket adjacent each said drainage slot for enhancing fluid flow into said center drainage slots and for reducing bluid-up of fibrous material at said pockets;

a plurality of tapered elongated housing screen bars disposed in the wall of said housing and forming housing drainage slots between each said tapered housing screen bar and a conventional housing screen bar;

each said tapered housing screen bar having an interior surface which tapers radially inward into said compression chamber in the direction of the moving fibrous material;

each said tapered housing screen bar includes a drainage cavity therein having an inlet in said interior surface and an outlet exiting from said compression chamber;

said drainage cavity for increasing the outward flow of expressed fluids from said compression chamber;

each said tapered housing screen bar and each said conventional housing screen bar are longitudinally aligned with the axis of said main shaft;

said worms segmented and having a plurality of worm flights;

each said worm flight including means for releaseable retention into a mating worm flight cavity in said collar;

said worm flight retention means including interengaging structure at one end of each said worm flight and one end of each said worm flight cavity in said collar such that, when each said worm flight is positioned in one said worm flight cavity for use, said worm flight cavity end overlaps and secures said one end of said worm flight;

said worm flight retention means also including a keystone releaseably securable in said worm flight cavity adjacent the other end of said worm flight such that said keystone overlaps and secures the other end of said worm flight.

20. An improved high pressure mechanical screw press as set forth in claim 19, wherein:

said center drainage slots and apertures are generally elongated and longitudinally disposed.

21. An improved high pressure mechanical screw press as set forth in claim 19, wherein:

each said tapered housing screen bar and each said conventional housing screen bar are nonaligned with the axis of said main shaft and slanting counter to rotation of said main shaft.

22. An improved high pressure mechanical screw press as set forth in claim 19, wherein the worm flight retention means also includes:

at least one pair of interengaging locking dogs, the first said locking dog connected to a wall of each said worm flight cavity, the second said locking dog connected to a side of each said worm flight;

said first and second locking dogs moving into rotational alignment as each said worm flight is positioned in said worm flight cavity for use, said first locking dog then radially outward from, and against, said second locking dog.

23. An improved method of operating a high pressure mechanical screw press system for removal of fluids from organic materials such as sugar cane, meal, nuts, bagasse and other fibrous materials including a hollow main shaft, at least one pressure chamber having an outer cylindrical housing, at least one feed worm, and collars arranged on said hollow main shaft, securing means for securing said worms and collars on said hollow main shaft, said worms rotationally driven by said hollow main shaft to express fluids from the material within at least one pressure chamber, wherein the steps comprise:

a. depositing a quantity of fibrous material into said pressure chamber;

b. rotating said main shaft to compress the fibrous material and to express fluids therefrom;

c. intermittently relaxing said compression of the fibrous material;

d. injecting compressed gas into said compression chamber and fibrous material during said intermittent relaxation to loosen and redistribute the fibrous material;

24. In a high pressure mechanical screw press system for removal of fluids from organic materials such as sugar cane, meal, nuts, bagasse and other fibrous materials including a hollow main shaft, at least one pressure chamber having an outer cylindrical housing, at least one feed worm, and collars arranged on said hollow main shaft, securing means for securing said worms and collars on said hollow main shaft, said worms rotationally driven by said hollow main shaft to express fluids from the fibrous material within said at least one pressure chamber, wherein the improvement comprises:

a plurality of replaceable housing screen bar inserts disposed in the wall of said housing;

each said housing screen bar inserts having a plurality of elongated longitudinally disposed housing drainage slots therethrough.

* * * * *